US008302330B2

(12) United States Patent
Doran

(10) Patent No.: US 8,302,330 B2
(45) Date of Patent: Nov. 6, 2012

(54) FOOTWEAR AND SYSTEMS AND METHODS FOR MERCHANDISING FOOTWEAR

(76) Inventor: Mark Doran, Port St. Lucie, FL (US)

( * ) Notice: Subject to any disclaimer, the term of this patent is extended or adjusted under 35 U.S.C. 154(b) by 1072 days.

(21) Appl. No.: 11/894,517

(22) Filed: Aug. 21, 2007

(65) Prior Publication Data

US 2008/0256828 A1 Oct. 23, 2008

Related U.S. Application Data

(60) Provisional application No. 60/913,106, filed on Apr. 20, 2007.

(51) Int. Cl.
*A43B 3/24* (2006.01)
*A43B 3/10* (2006.01)
*A43B 13/38* (2006.01)

(52) U.S. Cl. ..... 36/100; 36/9 R; 36/102; 36/43

(58) Field of Classification Search ..... 36/9 R, 36/88, 25 R, 43, 100, 102
See application file for complete search history.

(56) References Cited

U.S. PATENT DOCUMENTS

| | | | | | |
|---|---|---|---|---|---|
| 1,795,305 | A | * | 3/1931 | Jacob | 36/9 R |
| 3,229,819 | A | * | 1/1966 | Berk | 248/220.31 |
| 3,292,797 | A | * | 12/1966 | Berk | 211/163 |
| 4,101,704 | A | * | 7/1978 | Hiles | 428/218 |
| 4,378,642 | A | * | 4/1983 | Light et al. | 36/35 R |
| 4,472,912 | A | * | 9/1984 | Pipp | 52/28 |
| 4,674,204 | A | | 6/1987 | Sullivan et al. | |
| 4,899,412 | A | * | 2/1990 | Ganon | 12/142 A |
| 4,930,232 | A | | 6/1990 | Engle | |
| 5,289,644 | A | * | 3/1994 | Driskill et al. | 36/14 |
| 5,544,431 | A | | 8/1996 | Dixon | |
| 5,572,805 | A | | 11/1996 | Giese et al. | |
| 5,575,089 | A | | 11/1996 | Giese et al. | |
| 5,671,055 | A | | 9/1997 | Whittlesey et al. | |
| 5,732,481 | A | * | 3/1998 | Farhad | 36/44 |
| 5,741,568 | A | | 4/1998 | Rudy | |
| 5,855,818 | A | * | 1/1999 | Gan et al. | 252/511 |
| 5,901,394 | A | * | 5/1999 | Greenawalt | 12/142 N |
| 6,112,432 | A | * | 9/2000 | Bray et al. | 36/44 |
| 6,270,872 | B1 | * | 8/2001 | Cline et al. | 428/40.1 |
| 6,408,543 | B1 | * | 6/2002 | Erickson et al. | 36/100 |
| 6,418,642 | B1 | * | 7/2002 | Bigg et al. | 36/30 R |
| 6,484,419 | B1 | * | 11/2002 | Rohde et al. | 36/10 |
| 6,854,198 | B2 | | 2/2005 | Brooks | |
| 6,939,502 | B2 | | 9/2005 | Lyden | |
| 2005/0217142 | A1 | | 10/2005 | Ellis, III | |
| 2005/0262736 | A1 | * | 12/2005 | Peoples | 36/44 |
| 2007/0068039 | A1 | * | 3/2007 | Nau | 36/25 R |
| 2008/0010867 | A1 | * | 1/2008 | Davis, III | 36/136 |

* cited by examiner

*Primary Examiner* — Jila M Mohandesi
(74) *Attorney, Agent, or Firm* — Dinsmore & Shohl LLP

(57) ABSTRACT

In one embodiment, a slipper product line is provided comprising at least nine models of slippers, with at least three different sizes and at least three levels of firmness. Each of the slippers comprises a sole portion, an upper portion attached to the sole portion and configured for retaining the slipper on a wearer's foot, and a support portion located within the sole portion, wherein said models of slippers within the product line differ only in size and the cushioning properties of the support portion. In one embodiment, a slipper product line is provided comprising at least two different models of slippers, with at least two levels of firmness.

6 Claims, 4 Drawing Sheets

FOOTWEAR AND SYSTEMS AND METHODS FOR MERCHANDISING FOOTWEAR

CROSS REFERENCE TO RELATED APPLICATIONS

This application claims the benefit of U.S. Provisional Patent Application No. 60/913,106 filed Apr. 20, 2007.

TECHNICAL FIELD

The present invention relates to a line of footwear and, more specifically, to a slipper product line having multiple sizes and differing levels of firmness and a method of merchandising the same.

BACKGROUND OF THE INVENTION

Footwear such as slippers is typically manufactured and sold only by size. While shoes are manufactured and sold in a wide variety of sizes, slippers and similar types of footwear are usually only manufactured and sold in a limited number of sizes (e.g., small, medium and large). In addition, most retailers only sell one or two varieties of slippers, thus further limiting the options available to consumers. The result is that consumers must often either visit several retailers to find their preferred type of slippers, or must purchase slippers which do not necessarily meet their needs and desires.

SUMMARY

In one embodiment, the present invention may comprise a slipper product line having at least nine models of slippers. The slippers may have three different sizes with each size having at least three levels of firmness. Each slipper model may comprise a sole portion, an upper portion attached to the sole portion and configured for retaining the slipper on a wearer's foot, and a support portion located within the sole portion. The models of slippers within the product line may differ in size and the cushioning properties of the support portion.

Another aspect of the present invention is a method for merchandising footwear. The method may comprise providing footwear in two or more sizes with each size having two or more levels of firmness. The footwear may be displayed such that indicia of the levels of firmness of the footwear is visible to the consumer.

Another aspect of the present invention is a slipper. The slipper may comprise an upper attached to a sole, the sole having an insole, an outsole, and a support portion. The support portion may have three levels of firmness, specifically soft, medium, and firm.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DESCRIPTION OF ILLUSTRATIVE EMBODIMENTS

Embodiments of the present invention provide systems and methods for merchandising footwear. In one embodiment, the footwear may comprise slippers having a plurality of levels of firmness. Other embodiments may provide a collection (i.e., a product line) of slippers in a predetermined number of sizes and a predetermined number of levels of firmness. As discussed later herein, except for size and the particular type of support portion (e.g., type of foam), the slippers in such collection may be virtually identical in construction. Another embodiment may provide a slipper having different levels of firmness.

Typically, slippers will vary in firmness from one brand to another. One embodiment of the present invention provides systems and methods for merchandising slippers wherein not only are the slippers provided in a plurality of sizes, but also in a plurality of levels of firmness. By way of example, the slippers may be provided in three or more sizes (e.g., small, medium and large, and possibly a fourth size of extra large) and three or more levels of firmness for each size (e.g., soft, medium and firm). The slippers may be merchandized such that indicia identifying the level of firmness are visible to consumers.

Figure 1A:
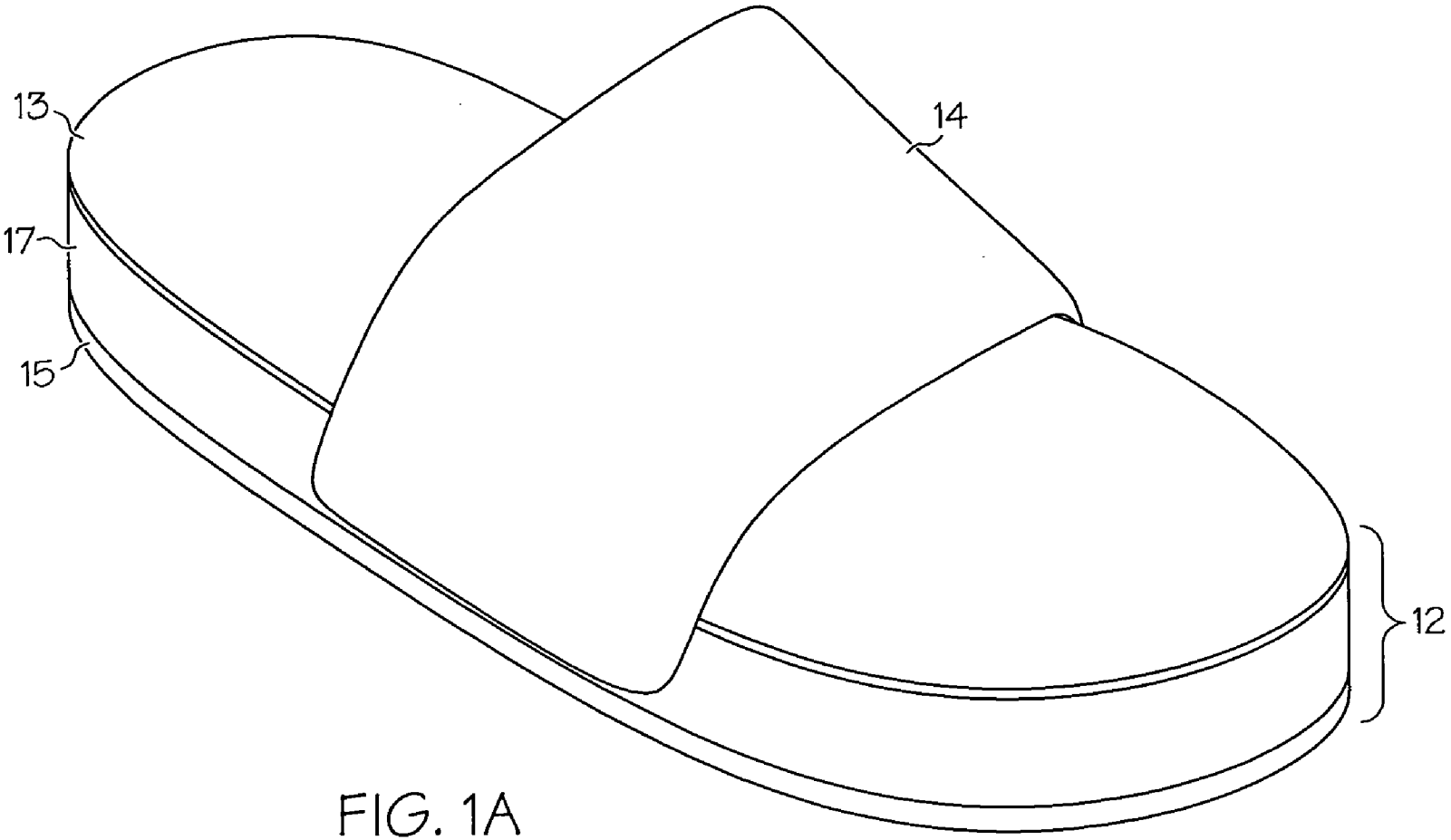
FIG. 1A is a perspective view of an exemplary embodiment of the slipper according to one aspect of the present invention.
Figure 1B:
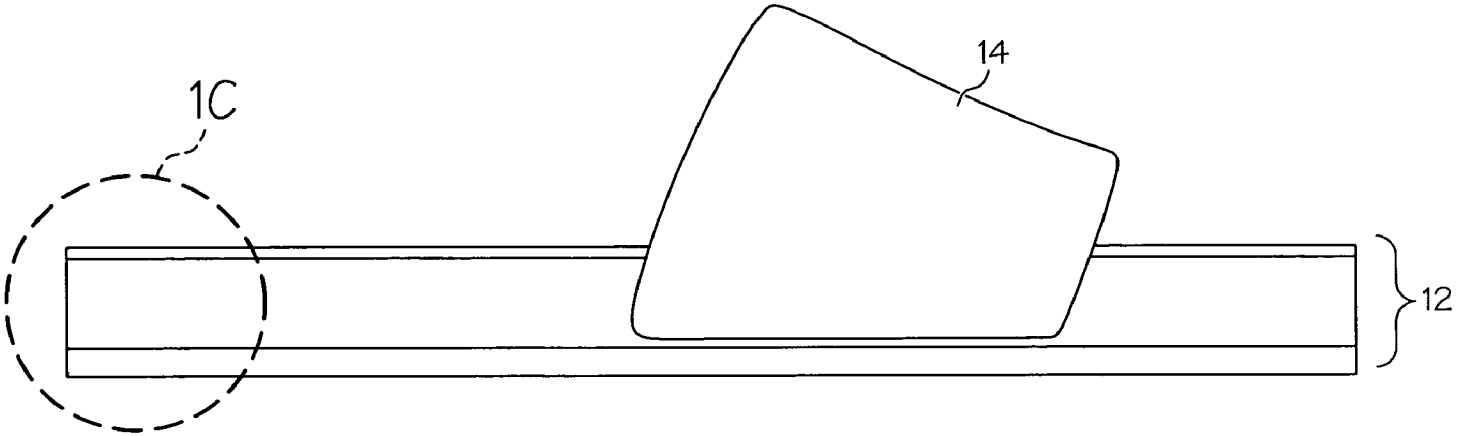
FIG. 1B is a side view of the exemplary embodiment of FIG. 1A.
Figure 1C:
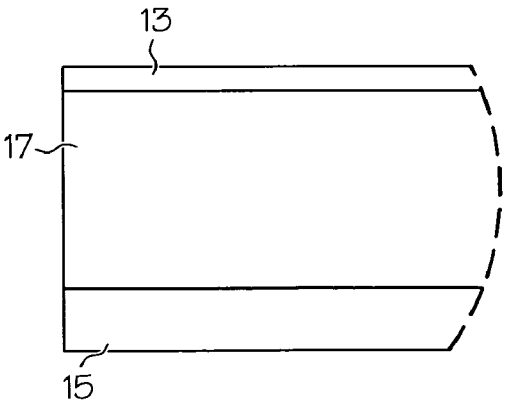
FIG. 1C is a magnified view of a portion of the exemplary embodiment shown in FIG. 1B.

FIGS. 1A, 1B, and 1C depict a slipper according to an exemplary embodiment of the present invention. The slipper generally includes a bottom portion, or sole 12, which is attached to an upper portion 14 (commonly referred to as the "upper"). The shape and configuration of the exemplary embodiment of the slipper shown in FIGS. 1A, 1B, and 1C is merely exemplary, as any of a variety of styles and constructions may be used. The sole 12 may include a support portion 17 located between the insole 13 and the outsole 15 of the sole (the insole is the surface on which the foot is positioned, and the outsole is the surface which contacts the ground during use). The support portion 17 may comprise any of a variety of materials which supports and cushions the wearer's foot. For slippers, a foam material generally cut to the shape of the sole is typically used, such as an open or closed cell foam. During manufacture, the support portion 17 is inserted into the sole between the insole and outsole and secured. In one embodiment, after insertion of the support portion 17, the outer perimeter of the sole 12 may be closed by attaching the insole 13 to the outsole 15 (e.g., by stitching). The sole 12 and upper 14 may be made from any of a variety of materials commonly used in the manufacture of footwear, including materials developed hereafter. Suitable materials for the uppers and soles include natural and man-made materials such as leather and/or polymeric materials (e.g., polyester uppers and rubber or other polymer soles).

The level of firmness of, and support provided by, a slipper will often depend primarily on the thickness and material of the support portion 17. In the case of foam, a variety of factors dictate the level of firmness, such as the chemical composition, the size of the cells within the foam, and the foam density. Firmness can also be quantified in a variety of ways, such as Indention Force Deflection (IFD), Compression Force Deflection (CFD) or Compression Modulus. These are well-known tests which generally measure the amount of force needed to compress the foam.

In embodiments of the present invention, the construction of the slippers may be the same across the various sizes and levels of firmness. The level of firmness may be controlled, in whole or in part, by varying the thickness of the support portion 17. In other embodiments, the support portion 17 may have approximately the same thickness (e.g., about one inch) regardless of slipper size or level of firmness. In these embodiments, the level of firmness may be varied by selecting a foam (or other material) for the support portion 17 which has different compression properties, rather than by changing the thickness of foam. In this manner, for a given slipper size, one aspect that can change in order to provide a different firmness is the properties of the foam or other material used for the support portion 17 (as further described herein). This aspect of embodiments of the present invention simplifies the manufacturing process and reduces costs.

The level of firmness best suited for a particular consumer will depend on a variety of factors such as the consumer's weight, intended use of the slippers, and personal preferences. In order to facilitate a consumer's selection of slippers which meet their needs and/or desires, the slippers may be merchandised such that visible indicia of the size and level of firmness is provided. As used herein, the term "merchandise" refers to the display or presentation of slippers (or other footwear) for sale to consumers. Merchandising may be accomplished using any of a variety of well-known means, such as display racks or even using an online webpage depicting the slippers.

Visible indicia of slipper size and firmness may be provided in a variety of ways. By way of example, a color coded system may be employed in order to indicate the level of firmness of the slippers. Each level of firmness may be identified by a predetermined color assigned to each level (e.g., green=soft, yellow=medium, blue=firm). Firmness may also be indicated using alphanumeric characters, such as the words "soft", "medium", and "firm", or letters (e.g., S, M and F) and/or numbers identifying firmness. Other non-alphanumeric or visual indicators of firmness may also be used. The color, symbol and/or alphanumeric characters indicating firmness may be associated with the slippers in a variety of manners. For example, the visible indicia of firmness may be provided on a size tag, price tag, a tag attached to the slippers or slipper packaging, and/or provided on a merchandising rack or other structure associated with a retail display of slippers. A merchandising rack may even be structured so as to provide a means for segregating slippers by firmness and/or size (e.g., separate cubby holes or other discrete locations for each size and firmness). When slippers are merchandised online, similar techniques may be used in order to provide visible indicia of firmness and size to consumers (e.g., color-coding for firmness and/or alphanumeric characters indicating firmness and/or size).

As mentioned previously, a variety of materials may be used in the construction of the slippers (or other footwear) according to various embodiments. For example, the sole portion 12 may be made from natural (e.g., leather) and/or man-made materials (e.g., synthetic rubber or other polymer). The insole 13 and outsole 15 surfaces of the sole 12 portion may be the same or different. By way of example, a second material may be attached to the sole portion 12 in order to provide a more comfortable insole 13 (e.g., felt, wool, or other soft material). Similarly, the outsole 15 may be of a different material than the other portions of the sole 12 (e.g., leather, rubber or other polymeric material to improve grip). The upper 14 may likewise be made from a variety of materials, such as leather, polyester, and/or other natural or man-made materials.

Likewise, any of a variety of materials may be used for the support portion 17, particularly foams which provide the desired level of cushioning (e.g., predetermined compression parameters such as IFD, CFD and/or Compression Modulus). Suitable foams include open-cell and/or closed-cell polyurethane. One example of a suitable foam material is an open-cell polyurethane which is available from Illbruck Foamtec, Inc. in a variety of densities and compression parameters. Such foams are available with a variety of properties, each having a different product name.

In one embodiment, one (1) inch thick foam can be utilized. The foam can be provided in three (3) different densities in order to provide varying levels of compression based on the weight applied to the surface area of the product. Table 1 provides technical data for three examples of foams that can be utilized to provide three varying levels of firmness. Foams from Illbruck Foamtec, Inc. may be used in some embodiments, such as an open-cell foam product for instance. However, closed-cell foam may be utilized in other embodiments to provide desired wear and rebound characteristics.

A color coded system can also be provided in some embodiments, and it can be allocated to the size tag, price tag or separately tagged to the slippers indicating the level of firmness. The consumer may then be free to select any "color" or firmness it desires based on personal preferences.

For example, the following system can be utilized:

| Color | Firmness |
|---|---|
| Green | Soft |
| Yellow | Medium |
| Blue | Firm |

Additionally, in some embodiments, the manufacturing process and the system can be optimized by providing firmness choices of the slippers in three (3) general sizes: small, medium, and large, and these sizes may correspond to the following approximate lengths of foam to be used in the slippers;

| Size of Slipper | Length of Foam |
|---|---|
| Small | ~9.5" |
| Medium | ~11.0" |
| Large | ~12.5" |

However, other sizes of slippers may be utilized, and the length of foam inside the slippers might vary. In some embodiments, the widths could vary as the length varies between slippers, and widths such as A, EEE, narrow, wide, etc. could be provided in one or more of the sizes Various shapes, soles (rubber, leather, etc), outer materials (leather, polyester, cotton, blends, etc.) can be utilized, depending on the embodiment. Celebrities such as sports personalities and the like could be utilized in the marketing and advertising of the product.

Table 1 illustrates specifications of examples of foams that could be utilized for the slippers described herein. Such slippers could utilize foams having one or more of the specifications shown. For example, the foam for a soft firmness slipper in the product line may have a firmness of between 0 and 6

(using the ASTM D2240 test method), a foam for a medium firmness slipper in the product line may have a firmness of between 6 and 10, and a foam for a hard firmness slipper in the product line may have a firmness of greater than 10 (e.g., 20). As one example, the soft firmness slipper may utilize Illbruckfoamtec material HD1506RE, the medium firmness slipper may utilize Illbruckfoamtec material HD0807RE, and the hard firmness slipper may utilize Illbruckfoamtec material HD0820RE.

TABLE 1

| | POLYURETHANE FOAM PRODUCTS | | |
|---|---|---|---|
| | HD1506RE | HD0807RE | HD0820RE |
| Density (#/Cu. Ft.) (ASTM D3574) | 11-15 | 6.5-9.5 | 6.5-9.5 |
| Hardness (Shore 0) (ASTM D2240) | 6 | 7 | 20 |
| Compression set (50%-22 hrs) (ASTM D1056 @ 73° F.) | 3% maximum | 3% maximum | 3% maximum |
| Tensile Strength (PSI) (ASTM D3574) | 55 minimum | 65 minimum | 75 minimum |
| % Elongation (ASTM D3574) | 100 minimum | 100 minimum | 50 minimum |
| Compression Force Deflection (ASTM D3574 @ 25% deflection) | 2-6 PSI | 2-6 PSI | 5-9 PSI |
| Tear Strength (PLI) (ASTM D624) | 5 minimum | 6 minimum | 5 minimum |

From "Polyurethane Foam Material Safety Data Sheet," Illbruck Foamtec, Inc., 3800 Washington Avenue North, Minneapolis, MN 55412, USA. Jan. 30, 2006.

Figure 2A:
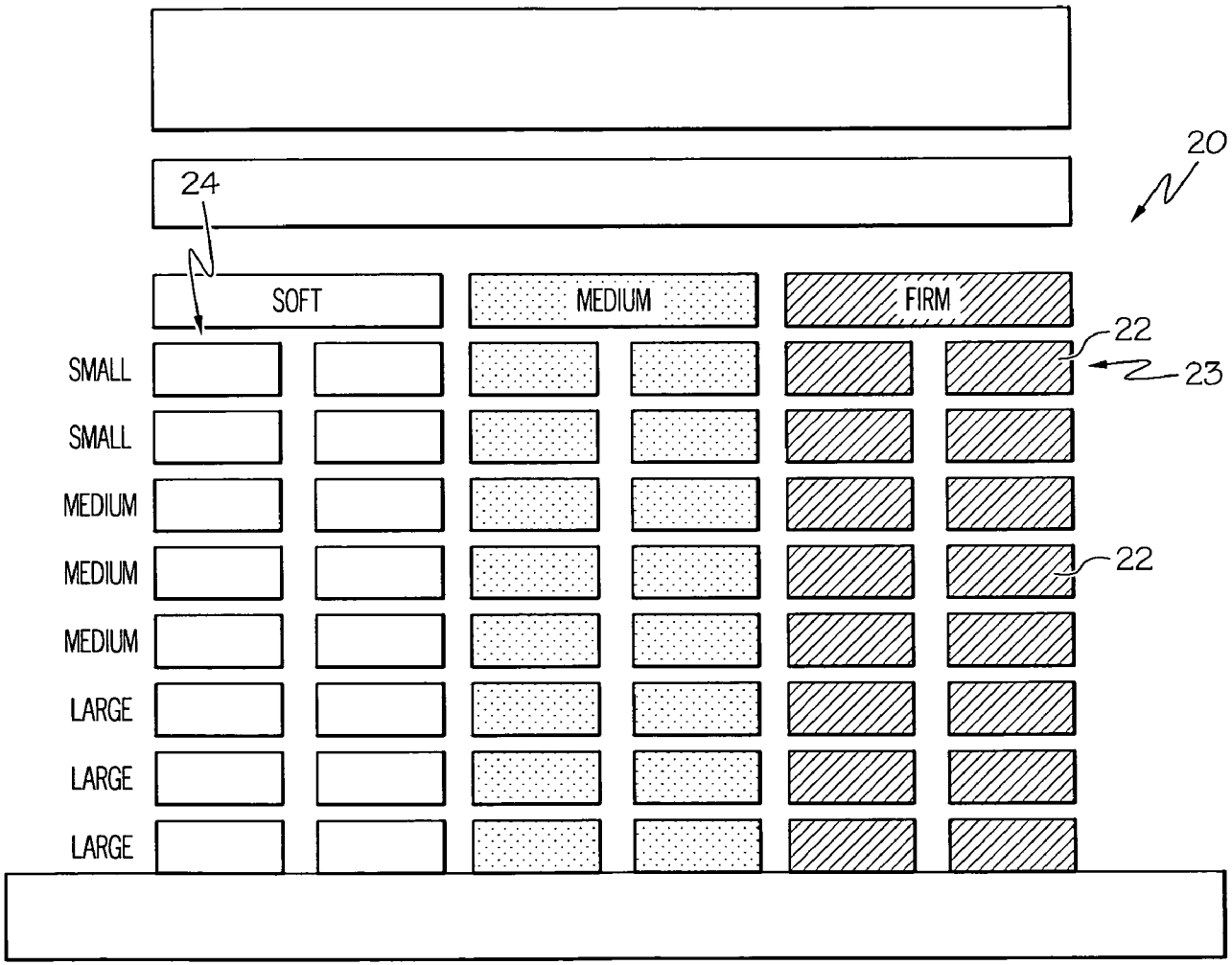
FIG. 2A is a depiction of an exemplary embodiment of a merchandising rack for footwear available in three sizes and three levels of firmness.
Figure 2B:
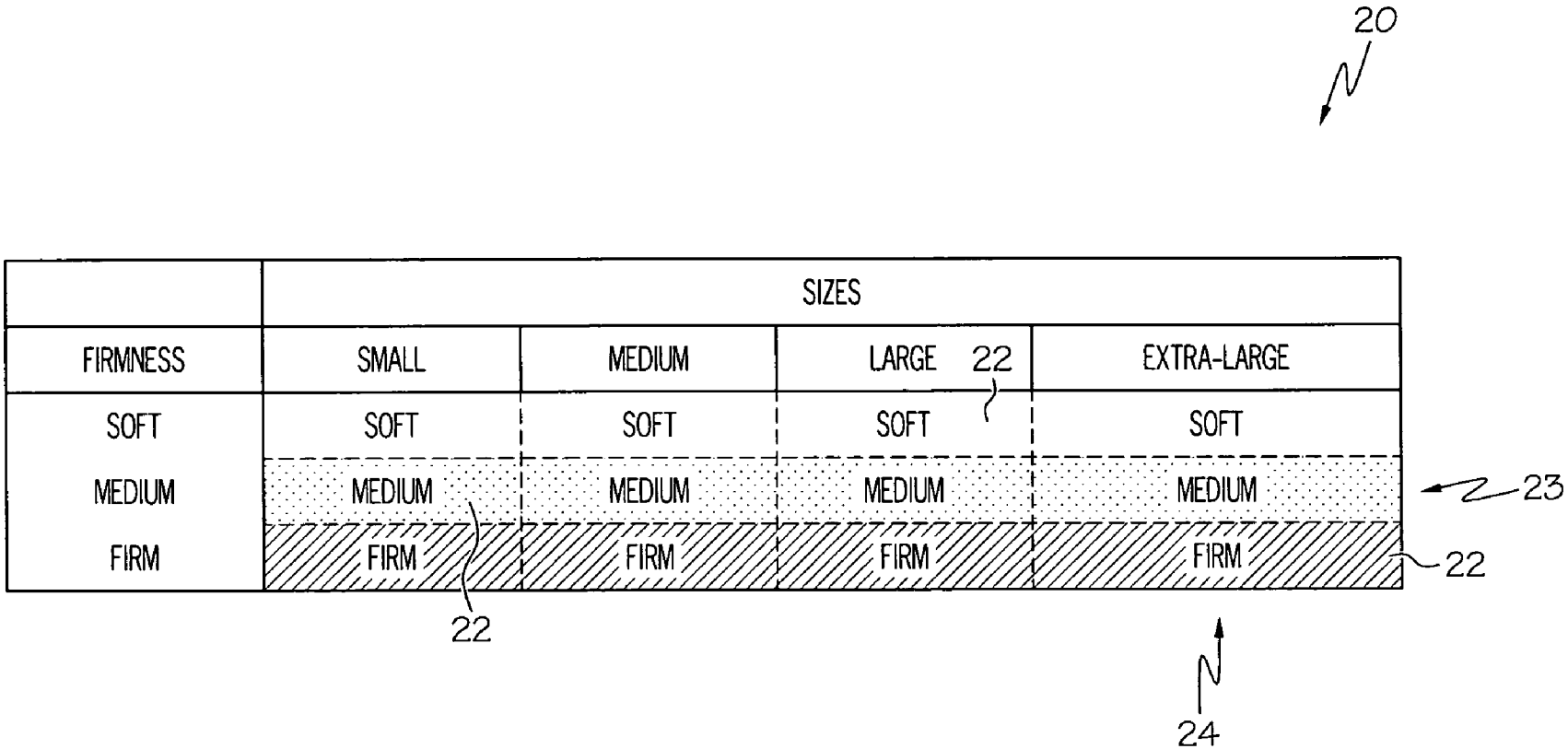
FIG. 2B is a depiction of another exemplary embodiment of a merchandising rack for footwear available in three sizes and three levels of firmness.

FIG. 2A is a depiction of one example of a merchandising rack 20 (e.g., a display rack) for slippers available in three sizes and three levels of firmness. The merchandising rack comprises a grid of cubby holes 22 in which slippers may be placed. Visible indicia of size and firmness may be provided across the top (or bottom) and one (or both) sides of the rack. In the exemplary embodiment shown, the slippers are segregated in the display by size (small, medium or large) as well as firmness. Size can be indicated by visible indicia comprising the word describing the size aligned with one or more rows 23 of cubby holes 22 along one side of the rack. Of course any of a variety of visible indicia of size may be used (e.g., single letter designation such as S, M and L). Firmness is indicated by a word descriptor located above each column 24 of cubby holes 22, and the label at the top of each column 24 may also be color coded (as indicated by the shading shown in FIG. 2A for each level of firmness. In this manner, consumers can easily select the desired size and level of firmness merely by selecting slippers from a cubby hole 22 located in the proper row 23 and column 24. Of course this is merely exemplary of one possible method for merchandising slippers so as to identify size and firmness. It should be understood that the slippers themselves may include visible indicia of size and firmness, such as on a tag attached to the slippers and/or packaging for the slippers. By way of example, each pair of slippers may include a hang tag which is color coded for the level of firmness and also includes a visible indicia of size (e.g., a single letter such as S, M or L). Other arrangements are also possible, such as shown in the example of FIG. 2B, for instance.

The foregoing description of various embodiments and principles of the inventions has been presented for the purposes of illustration and description. It is not intended to be exhaustive or to limit the inventions to the precise form disclosed. Many alternatives, modifications and variations will be apparent to those skilled in the art. Moreover, although multiple inventive aspects and principles have been presented, such aspects need not be utilized in combination, and various combinations of inventive aspects and principles are possible in light of the various embodiments provided above. Accordingly, the above description is intended to embrace all possible alternatives, modifications, aspects, combinations, principles, and variations that have been discussed or suggested herein, as well as all others that fall within the principles, spirit and broad scope of the inventions as defined by the claims.

What is claimed is:

1. A slipper product line comprising at least nine models of slippers, with at least three different sizes and at least three levels of firmness, each of said slippers comprising a sole portion, an upper portion attached to the sole portion and configured for retaining the slipper on a wearer's foot, and a support portion located within the sole portion, wherein:

the models of slippers within the product line differ only in size and level of firmness of the support portion;

each model of slipper within the product line is classified into one of the three levels of firmness based on the firmness of the support portion and one of the three sizes;

each slipper is labeled with visual indicia that corresponds to the level of firmness of the support portion; and the at least three levels of firmness comprise soft, medium and firm corresponding to a Shore 0 scale such that a slipper classified as soft comprises a support portion having a firmness of about 0 to 6 on the scale, a slipper classified as medium comprises a support portion having a firmness of about 6 to 10 on the scale, and slipper classified as firm comprises a support portion having a firmness greater than 10 on the scale.

2. The slipper product line of claim 1 wherein the support portions differ in firmness among the three levels of firmness and wherein the support portions comprise polyurethane foam.

3. The slipper of claim 2 wherein the polyurethane foam is open-cell polyurethane foam.

4. The slipper of claim 2 wherein the polyurethane foam is close-cell polyurethane foam.

5. The slipper of claim 1 wherein the visible indicia comprises a tag indicating the level of firmness.

6. The slipper of claim 1 wherein the visible indicia comprises a unique color related to each level of firmness.

* * * * *